US005297638A

United States Patent [19]

Dolence, Jr.

[11] Patent Number: 5,297,638

[45] Date of Patent: Mar. 29, 1994

[54] DRIVEPIPE GUIDE AND INSTALLATION METHOD FOR WELLS

[75] Inventor: Thomas W. Dolence, Jr., Houston, Tex.

[73] Assignee: Atlantic Richfield Company, Los Angeles, Calif.

[21] Appl. No.: 987,935

[22] Filed: Dec. 8, 1992

[51] Int. Cl.[5] ..... E21B 7/08

[52] U.S. Cl. ..... 175/61; 175/77; 175/80; 175/81

[58] Field of Search ..... 175/7, 9, 10, 61, 80, 175/82, 77

[56] References Cited

U.S. PATENT DOCUMENTS

| | | | |
|---|---|---|---|
| 1,900,163 | 3/1933 | Dana et al. | 175/9 |
| 2,105,722 | 1/1938 | Barrett et al. | 175/82 |
| 2,158,329 | 5/1939 | Kinzleach | 175/61 |
| 2,797,893 | 7/1957 | McCune et al. | 175/61 |
| 3,116,799 | 1/1964 | Lemons | 175/61 |
| 3,194,327 | 7/1965 | Smithson | 175/61 |
| 3,330,349 | 7/1967 | Owsley et al. | 175/61 |
| 4,027,734 | 6/1977 | Horvah | 175/9 |
| 4,068,729 | 1/1978 | Peevey | 175/9 |
| 4,733,732 | 3/1988 | Lynch | 175/9 |
| 5,115,072 | 5/1992 | Burnet et al. | 175/61 |

*Primary Examiner*—Ramon S. Britts
*Assistant Examiner*—Frank S. Tsay
*Attorney, Agent, or Firm*—Michael E. Martin

[57] ABSTRACT

Offshore well slots are recovered by cutting off old drive or surface pipe below the mud line to form a stub end. A new drivepipe is installed with a guide and shield device disposed on the scarfed lower end or "mule shoe" of the new drivepipe. The guide and shield device includes a saddle contiguous with the lower end of the new drivepipe having one or more hooks formed on the outer surface thereof for engagement with the stub end to locate the device and the new drivepipe. Shear pins interconnect the new drivepipe with the device and are sheared in response to downward driving action on the new drivepipe or allowing the full weight of the drivepipe to be exerted on the shield device after engagement with the old drivepipe.

17 Claims, 1 Drawing Sheet

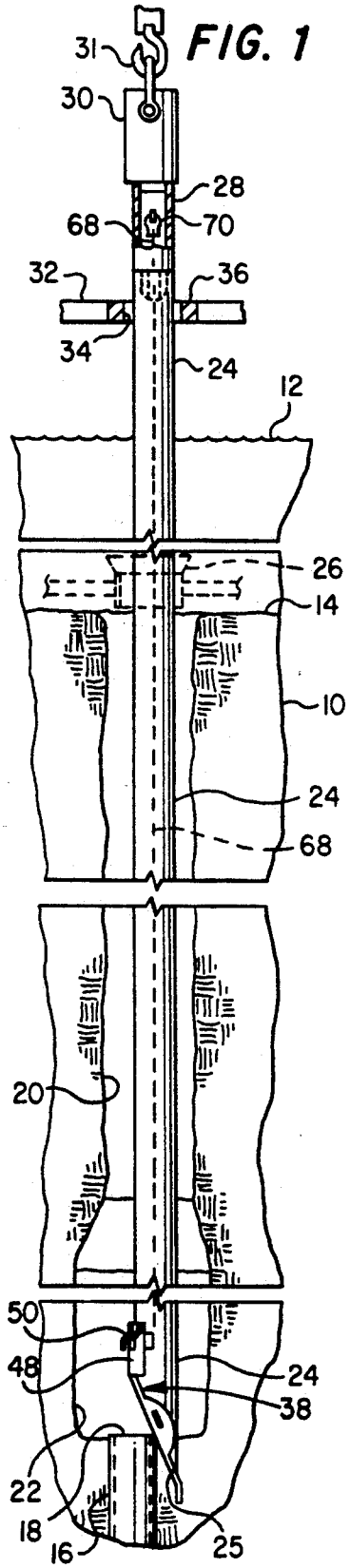
FIG. 1
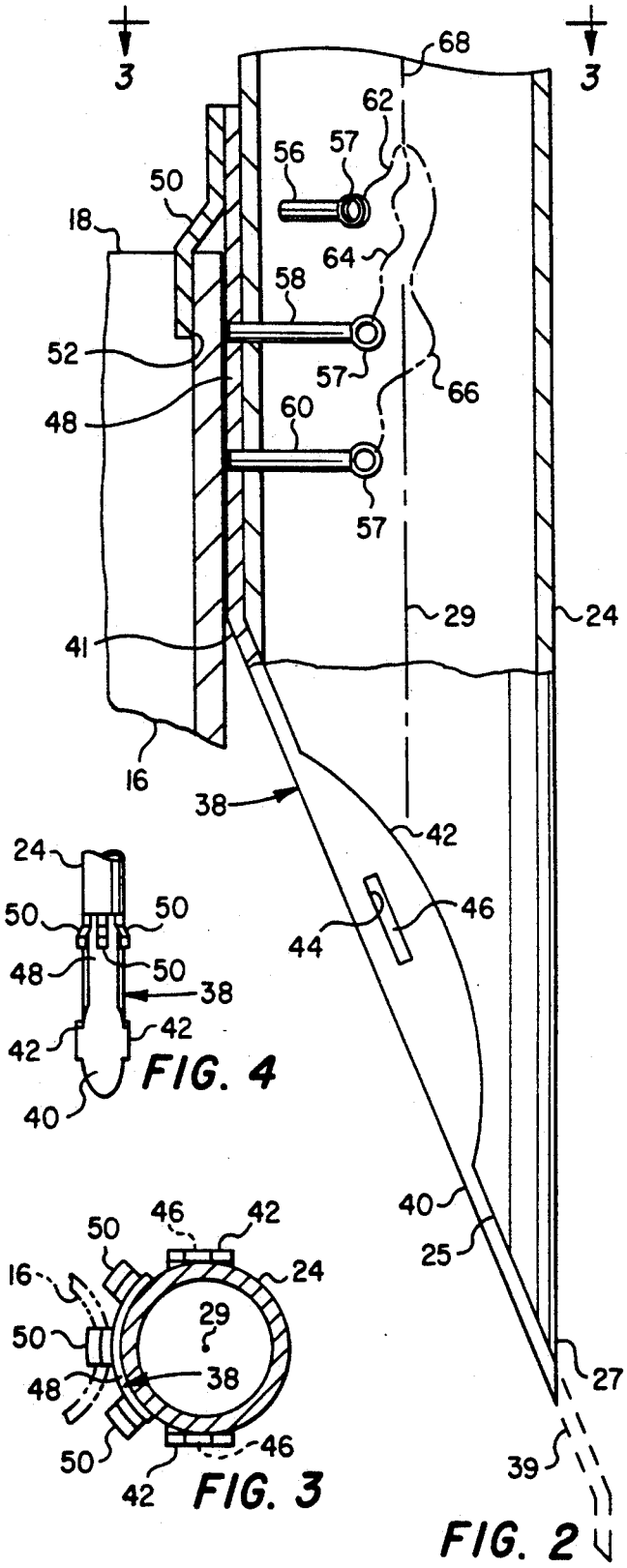
FIG. 2
FIG. 4
FIG. 3

DRIVEPIPE GUIDE AND INSTALLATION METHOD FOR WELLS

BACKGROUND OF THE INVENTION

1. Field of the Invention

The present invention pertains to a guide and shield device which is attachable to the lower end of a new drivepipe for an offshore well so that the new drivepipe may be driven alongside the stub end of a previous drivepipe.

2. Background

In the drilling of offshore oil and gas wells, in particular, a conventional technique involves driving a relatively large-diameter pipe into the sea floor to form a structure through which the well may be drilled and completed. This casing or so-called "drivepipe" may encounter a subterranean blockage or other impediment to being driven to a sufficient depth to support the well, or the drivepipe may otherwise be damaged or a slot may need to be reclaimed for a production platform. In some instances a deflector or so-called whipstock is installed on top of the first drivepipe so that a second drivepipe may be guided in the direction that the well is to be drilled.

If the original drivepipe is to be abandoned, it is usually cut off below the sea floor and the whipstock is connected to the lower end of the new drivepipe and stabbed into or over the top of the old drivepipe to form the guide for the new drivepipe. One example of a whipstock for the above type of operation is described in U.S. Pat. 4,733,732 to Samuel C. Lynch and assigned to the assignee of the present invention. Although a whipstock as described in the '732 patent is advantageous for certain applications, it is often difficult to properly stab the whipstock into or sleeve it over the stub of the old drivepipe. In particular, in offshore well operations it is very difficult to positively stab the whipstock spear in the old drivepipe or casing which has been abandoned and which is required to be located off of so that the new drivepipe will proceed in the proper direction. If a whipstock is not correctly located, it is also difficult to retrieve or "fish" it out of the wellbore, particularly if the drivepipe to which the fishing tool is connected is extended through the collarlike guides which are often used to guide drivepipe with respect to a platform structure or a subsea template. These guides are commonly used to centralize or locate drivepipe with respect to the platform or the desired location of the well.

Still another problem in using whipstocks, including the type described in the '732 patent, is the tendency for the lower end of the whipstock or the new drivepipe to which it is connected to encounter debris lying on the sea floor around the old drivepipe stub. Particularly, in installing new drivepipe in wells which have been damaged due to destruction or damage of the drilling platform, a great deal of debris may lie on the sea floor in and around the old drivepipe. The open end of the whipstock guide or the drivepipe to which it is connected will cause the new drivepipe or the whipstock to "swallow" the debris while it is being driven. This results in improper guidance of the new drivepipe and possibly added time to clean out the newly driven pipe, if such cleanout is even possible.

Accordingly, there has been a need to develop a new technique and device for guiding drivepipe to recover a so-called well "slot" and install a well directly adjacent to or essentially in the same vicinity of an abandoned drivepipe structure or the like. It is to this end that the present invention has been developed.

SUMMARY OF THE INVENTION

The present invention provides a unique guide and shield device for use in guiding well drivepipes in reentering or recovering wells wherein a previous drivepipe or subsea casing structure has been abandoned and has been cut off below the sea floor.

In accordance with one aspect of the present invention, a new drivepipe is cut at a relatively steep angle with respect to the central longitudinal axis to form a scarfed portion of the drivepipe or a so-called "mule shoe" wherein a unique shield and guide device is attached to the scarfed portion of the drivepipe and is adapted to engage the previously-driven drivepipe stub so as to properly locate the new drivepipe. Still further, the drivepipe guide and shield device of the present invention is operable to be disengaged from the new drivepipe upon encountering or becoming connected to the old drivepipe in response to shearing of connecting pins which interconnect the guide and shield device with the scarfed end of the new drivepipe.

The drivepipe guide and shield device alleviates several problems associated with driving new drivepipe to recover a previously-abandoned well slot. In particular, with the use of the present invention, it is not required to precisely stab a whipstock or similar mechanism into the stub end of the old drivepipe or to locate a collar or cap of a whipstock over the stub end. The guide and shield device is adapted to provide for the toe of the scarfed end of the new drivepipe to slide off of, but remain directly adjacent to, the existing drivepipe stub.

Still further, the unique guide and shield device, together with the method of the present invention, eliminates the requirement to fish a misrun or inoperable whipstock out of the old drivepipe stub and prevents the new drivepipe from "swallowing" debris or junk on the sea floor or around the old drivepipe.

In accordance with yet another advantage of the present invention, the drivepipe guide and shield device includes means for verifying that the device has been disconnected from the toe of the new drivepipe and serving as a secondary or backup means for disconnection of the device from the new drivepipe.

The drivepipe guide and shield device, as well as the improved method of installing a drivepipe which the device provides, substantially reduces the cost of installing new drivepipe in so-called well slot recovery operations. The guide and shield device is significantly less expensive than conventional submudline whipstocks and the method of the invention reduces the time to replace an improperly-driven or damaged drivepipe, particularly in the drilling of offshore oil and gas wells.

Those skilled in the art will recognize the above-described features and advantages of the present invention together with other superior aspects thereof upon reading the detailed description which follows in conjunction with the drawing.

BRIEF DESCRIPTION OF THE DRAWING

FIG. 1 is a view illustrating the installation of a new drivepipe adjacent to a previous abandoned drivepipe using the device and method of the present invention;

FIG. 2 is a detail view, partially sectioned, of the drivepipe guide and shield attached to the lower end of the new drivepipe and engaged with the old drivepipe;

FIG. 3 is a view taken generally from the line 3—3 of FIG. 2; and

FIG. 4 is a side elevation of the drivepipe guide and shield device.

DESCRIPTION OF PREFERRED EMBODIMENTS

In the description which follows, like elements are marked throughout the specification and drawing with the same reference numerals, respectively. The drawing figures are not necessarily to scale and certain features may be shown in somewhat schematic form in the interest of clarity and conciseness.

Referring to FIG. 1, there is illustrated a subsea earth formation 10 over which a body of water 12 lies and forms an interface with the formation 10 at the so-called mudline 14. FIG. 1 also illustrates an abandoned drivepipe 16 which has been driven into the formation 10 but must now be bypassed by a new drivepipe for one reason or another. The drivepipe 16 has an upper stub end 18 which may have been formed by cutting and removing a portion of the drivepipe, not shown, extending between the stub end 18 and the mud line 14.

FIG. 1 also illustrates a borehole 20 which extends downward from the mud line 14 to the upper end of the drivepipe 16 as delimited by the stub end 18. The borehole 20 has an underreamed or enlarged portion 22 extending upward from the stub end 18 a suitable distance which may, in accordance with the present invention, be on the order of about 25 feet. The borehole 20 has been enlarged from that previously formed by that portion of the drivepipe 16 which has been removed. The diameter of the borehole 20 may, for example, be about four to six inches larger than the diameter of the new drivepipe 24. The diameter of the enlarged portion 22 may be on the order of about two to three times the diameter of the new drivepipe 24.

FIG. 1 further illustrates a new drivepipe 24 being lowered through the borehole 20 and the enlarged portion 22 to engage the stub end 18. The new drivepipe 24 can be slightly smaller in diameter than the old drivepipe 16, particularly if the new drivepipe must be lowered through drivepipe or casing guides which have been previously installed as part of a subsea template resting on the mud line 14 or as part of a conventional platform jacket. In FIG. I, a typical casing guide is illustrated and designated by the numeral 26. In FIG. 1, the upper end of the drivepipe 24 is shown fitted with a drive sub 28 on which is mounted a conventional pile driving hammer 30. The hammer 30 and the drive sub 28, as well as the drivepipe 24, are adapted to be suspended from a conventional block and tackle arrangement 31, forming part of a drilling rig, not shown, and supported on a drilling platform, shown in part and generally designated by the numeral 32. The platform 32 has a suitable opening 34 formed in a deck structure 36 which may form a work floor for handling the drivepipe 24 during its installation together with the aforementioned tools and other working elements. Although the hammer 30 is shown in place for driving the drivepipe 24 in the position of the drivepipe shown in FIG. 1, it may not be necessary to use the hammer 30 until the drivepipe 24 has descended under its full weight past the position shown.

In the condition shown in FIG. 1, the drivepipe 24 has been lowered into position through casing guide 26, if used, and is engaged with the stub end 18 by a unique guide and shield device, generally designated by the numeral 38. The lower end 25 of the new drivepipe 24 has been cut or scarfed to form what is sometimes known in the art as the "mule shoe". Basically, the drivepipe 24 has been scarfed at a suitable angle with respect to the longitudinal central axis 29 of the drivepipe. This angle may be, but is not limited to, about fifteen to twenty degrees. This scarfed end 25 of the drivepipe 24 forms a relatively sharp lower distal part or toe 27, FIG. 2. The drivepipe guide and shield device 38 includes a shield portion 40 which has, generally, the elliptical shape of the scarfed end of the drivepipe 24 when viewed in the plane of the scarf. FIG. 4 shows that the shield portion 40 has the aforementioned generally elliptical shape.

The shield portion 40 is also provided with opposed, up-turned ears 42 which extend generally perpendicular to the plane of the shield portion 40 and are operable to maintain the shield portion 40 in its position shown covering the scarfed end of the drivepipe 24. Each of the opposed ears 42 may be provided with a suitable key slot 44, FIG. 2, in which is disposed a retaining key 46 suitably secured to the outer surface of the drivepipe 24 such as by welding. The upper end 41 of the shield portion 40 is secured to an arcuate saddle part 48 of the device 38 which preferably forms a segment of a cylinder, see FIGS. 2 and 3, and which is contiguous with the outer surface of the drivepipe 24. Plural, downward-opening hook members 50 are circumferentially spaced on the part 48 and have a downward-facing opening or throat portion 52, FIG. 2, for receiving and engagement with the upper stub end 18 of the old drivepipe 16, as shown.

The guide and shield device 38 is also secured to the drivepipe 24 by plural, circumferentially-spaced shear pins 56, 58, and 60, illustrated, which extend generally normal to the longitudinal central axis 29 of the drivepipe 24 through suitable bores in the drivepipe and into corresponding bores formed in the part 48 of the guide and shield device. The distal ends of the shear pins 56, 58 and 60 have suitable eye parts 57 whereby each of the pins may be connected to a flexible cable arrangement including respective cable tails 62, 64 and 66 which, each, are connected to a main cable 68. The main cable 68 extends through the drivepipe 24 to a clevis part 70, FIG. 1, which is suitably connected to the sub 28. The cable 68 is allowed to hang relatively loosely inside the drivepipe 24 during insertion thereof into the earth formation 10. The tails 62, 64 and 66 are of sufficient length, each, to allow the full tension, if any is exerted on the cable 68, to be applied to the respective pins 56, 58 and 60 seriatim so that the full tension of the cable may be used to break or pull each of the pins, if necessary, to disconnect the drivepipe 24 from the device 38.

The guide and shield device 38 is adapted to be secured to the lower end of the drivepipe 24, as illustrated and previously described, for engagement with the stub end 18 of the old drivepipe 16 to guide the new drivepipe 24 into a position generally adjacent the old drivepipe 16. As the new drivepipe 24 is lowered or driven into the earth formation 10 adjacent to the old drivepipe 16, one or more of the hooks 50 will catch on the upper stub end 18 to arrest downward movement of the device 38 whereupon, by allowing the full weight of the new drivepipe 24 to be applied to the device 38 or by application of a downward driving force on the drivepipe 24 by the hammer 30, the new drivepipe may be separated from the device 38 once it has been put in position alongside the old drivepipe. By predetermining the shear strength of the pins 56, 58 and 60, as well as the total number of pins used, the new drivepipe 24 will shear free of the device 38 on exerting a predetermined downward force on the pins. The ears 42 will also allow the keys 46 to exit the slots 44 as the new drivepipe 24 slides away from the shield part 40 of the device 38 and progresses generally downwardly and substantially alongside the old drivepipe 16. Moreover, the shield part 40 may be deflected downwardly and to the left, viewing FIGS. 1 and 2 as the new drivepipe shears itself free of the saddle part 48.

In any event, the new drivepipe 24 will deflect away from the old drivepipe 16 only an amount sufficient to allow the new drivepipe to progress generally downwardly in substantially the same direction as the old drivepipe. Alternatively, the new drivepipe 24 will tend to descend in the direction of the scarfed end 27 as is conventional for pipes which are driven with a "muleshoe" or scarfed end. In this regard, of course, the stiffness of the shield part 40 with respect to the saddle part 48 will be required to be substantial so that the shield part will not deflect away from the path of the new drivepipe 24 but will, at least in part, guide the path of the drivepipe.

The guide and shield device 38 may be formed of one of conventional engineering materials used in offshore oil and gas operations, including a suitable alloy or low-carbon steel. The device 38 may be formed of steel plate having about the same thickness as the wall thickness of the new drivepipe 24. The shear pins 56, 58 and 60 may also be formed of conventional engineering materials for such elements. The pins 56, 58 and 60 may be replaced by other fastener means capable of shearing in response to the direction of forces exerted between the drivepipe 24 and the device 38, such fastener means being threaded bolts, for example.

A preferred method for installing the new drivepipe 24 will now be described. When it is determined that the old drivepipe 16 is unsuitable for continued use, it is cut by conventional means, not shown, to form the stub end 18, preferably about 100 feet below the mud line 14. After removal of the severed section of old drivepipe, not shown, the borehole 20 may be enlarged by lowering a casing cutter or underreaming tool, not shown, on a suitable work string, also not shown, and having a cutting diameter at least about two inches larger than the old drivepipe 16. The aforementioned casing cutter or underreaming tool and may be operated to backream from the old drivepipe stub end 18 to the mudline 14 two or three times while pumping high viscosity mud "pills" through the borehole 20 to thoroughly clean the hole. After pulling the above-mentioned casing cutter out of the hole 20 a larger diameter casing cutter or underreamer, for example, one capable of cutting about two times the diameter of the old drivepipe 16 may be lowered on the drillstring and the hole enlarged to form the portion 22 extending upward from the stub end 18 about twenty-five feet or so. This underreaming or hole enlarging operation may be carried out two or three times while also pumping high viscosity mud "pills" through the drillstring to clean the cuttings from the borehole portion 22 and the borehole 20. After forming the enlarged portion 22, the casing cutter just mentioned is rested on the stub end 18 and then retrieved while measuring the length of pipe or distance from the deck 36 to the stub end 18.

The drivepipe 24, having been previously cut to form the toe 27 and the scarfed end 25, is fitted with the device 38, as illustrated, and is then lowered into the borehole 20 while monitoring the depth that the toe 27 is from the deck 36 to confirm engagement of the shield part 40 with the stub end 18. Once engagement has occurred, the new drivepipe 24 is then oriented in its preferred direction with respect to the old drivepipe 16 and the new drivepipe is then lowered further to engage at least one of the hooks 50 with the stub end 18 so that the device 38 is in the position illustrated in FIG. 2. If doubt exists with respect to the ability to locate the old drivepipe 16 with lowering of the new drivepipe 24, the device 38 may be provided with a telltale lower distal end portion 39, see FIG. 2, for engagement with the stub end 18 to more positively confirm "finding" the old drivepipe 16 with the new drivepipe. When the new drivepipe 24 is rigged up to be lowered in the hole 20 the drive sub 28 is installed at the upper end of the drivepipe and the cable 68 is rigged through the drivepipe and secured at the drive sub 28 by the clevis 70 or the like.

Once at least one of the hooks 50 is engaged with the stub end 18 and the new drivepipe 24 is oriented in the desired direction with respect to the old drivepipe 16 the pins 56, 58 and 60 are sheared by allowing the full weight of the drivepipe 24 to be exerted downwardly against the device 38. If the pins 56, 58 and 60 shear from the weight of the drivepipe 24, the drivepipe 24 is allowed to free fall until it is required to begin driving the pipe to the desired depth or to refusal, whichever is predetermined. Confirmation of shearing of the pins 56, 58 and 60 may be obtained by pulling up the cable 68. Moreover, if the aforementioned shear pins do not shear from the weight of the drivepipe 24, the hammer 30 may be installed on the drive sub 28 and energized to exert a downward driving force on the drivepipe 24 to effect shearing of the pins.

Whichever forces are required to effect shearing of the pins 56, 58 and 60, these forces will also be sufficient to slide the keys 46 out of the key slots 44 so that the drivepipe 24 will release from the shield part 40 as well as from the saddle 48 of the device 38. The shield part 40 will either be deflected out of the path of the new drivepipe 24 or will actually assist in guiding the new drivepipe off of the inclined surface of the device formed by the shield part 40 so that the new drivepipe progresses in the desired direction. Moreover, if the weight of the drivepipe 24 is not sufficient to shear the pins 56, 58 and 60, the cable 68 may be connected to suitable means for applying tension to the cable to assist in exerting a force on the shear pins which will effect shearing or release thereof to allow the drivepipe 24 to separate from the guide and shield device 38.

As the new drivepipe 24 is lowered into the borehole 20, the device 38 substantially prevents any debris or "junk" from being swallowed or moving into the lower end of the drivepipe 24 since this end has been covered by the shield part 40. Those skilled in the art will recognize that the device 38 is an inexpensive yet effective means of guiding and shielding the lower end of a scarfed drivepipe and to provide for positioning the pipe with respect to an old drivepipe stub end such as illustrated and described above. Although a preferred embodiment of a guide and shield device, together with a method of installation of a new drivepipe using such device, has been described herein, those skilled in the art will recognize that various substitutions and modifications may be made to the device and the method without departing from the scope and spirit of the appended claims.

What is claimed is:

1. A device for attachment to the lower end of a new drivepipe for an offshore well for guiding and shielding said new drivepipe during installation thereof alongside a stub end of an old drivepipe, said device comprising:

a shield part covering the lower distal end of said new drivepipe to shield same from swallowing debris and for engagement with the stub end of said old drivepipe;

a saddle part connected to said shield part and extending along and contiguous with a portion of said new drivepipe above said lower end; and means on said device engageable with said stub end of said old drivepipe for locating said device and said lower end of said new drivepipe with respect to said old drivepipe.

2. The device set forth in claim 1 including:

means for releasably securing said new drivepipe to said device.

3. The device set forth in claim 1 including:

means on said shield part for engaging the side of said drivepipe to prevent lateral excursion of said shield part with respect to said lower end of said drivepipe.

4. The device set forth in claim 1 including:

a distal end part of said shield part extending beyond the distal end of said drivepipe for engagement with said stub end of said old drivepipe during installation of said new drivepipe.

5. The device set forth in claim 1 wherein:

said saddle part comprises a generally arcuate part engageable with said new drivepipe.

6. The device set forth in claim 1 wherein:

said means engageable with said old drivepipe comprises a downwardly-opening hook secured to said saddle part.

7. The device set forth in claim 6 wherein:

said means engageable with said old drivepipe comprises a plurality of said hook means circumferentially spaced about said saddle and having a throat portion opening downward to engage said stub end of said old device.

8. The device set forth in claim 2 wherein:

said means for releasably securing said new drivepipe to said device comprises at least one shear pin interconnecting said device with said new drivepipe and responsive to a downwardly-exerted force on said new drivepipe to effect release of said new drivepipe from said device.

9. A device for attachment to the scarfed lower end of a new drivepipe for an offshore well for shielding said scarfed lower end and for guiding said new drivepipe to be driven into an earth formation adjacent to the stub end of an old drivepipe, said device comprising:

a shield part comprising a substantially flat plate having a shape conforming substantially to the shape of said scarfed lower end of said new drivepipe when viewed in the plane of said scarfed lower end;

a saddle part connected to said shield part and including a substantially arcuate support member for engagement with said new drivepipe above said scarfed lower end;

shear pin means interconnecting saddle part with said new drivepipe; and at least one hook means for engaging said device with said stub end of said old drivepipe to locate said device and said scarfed lower end of said new drivepipe with respect to said old drivepipe during installation of said new drivepipe.

10. In combination with a drivepipe for installation in an earth formation, said drivepipe having a scarfed lower end, a guide and shield device secured to said scarfed lower end and including a shield part covering said scarfed lower end, means for locating said shield part with respect to said scarfed lower end to prevent lateral displacement of said scarfed lower end relative to said shield part;

a body part extending upward from said shield part and engageable with said drivepipe;

at least one downwardly-facing hook secured to said body part for engagement with a stub end of an old drivepipe disposed in said formation;

at least one shear pin interconnecting said lower end of said new drivepipe with said device; and a cable connected to part of said at least one shear pin and extending through said drivepipe toward the upper end thereof and operable for one of indicating when said at least one shear pin has sheared to release said device from said new drivepipe and for releasing said at least one shear pin to effect release of said device from said new drivepipe.

11. A method of installing a drivepipe to recover a well slot for an offshore subterranean formation, said formation including a previously-installed pipe section having an upwardly-facing stub end, said method comprising the steps of:

forming a scarfed lower end of said drivepipe and installing a device for shielding said scarfed lower end and for guiding said drivepipe off of said stub end, said device including means engageable with said stub end for locating said drivepipe with respect to said pipe section;

lowering said drivepipe into engagement with said stub end and positioning said drivepipe for engagement of said means on said device with said stub end; and applying sufficient force to said new drivepipe to release said new drivepipe from said device for movement in a generally downward direction alongside said pipe section.

12. The method set forth in claim 11 including the step of:

allowing sufficient weight of said drivepipe to be exerted on said means to release said drivepipe from said device.

13. The method set forth in claim 11 including the step of:

driving said drivepipe in a generally downward direction to release said drivepipe from said device.

14. The method set forth in claim 11 including the step of:

forming an enlarged borehole above said stub end for receiving said drivepipe prior to lowering said drivepipe.

15. The method set forth in claim 14 including the step of:

underreaming a portion of said enlarged borehole directly above said stub end to provide room for deflection of said new drivepipe with respect to said stub end upon engagement thereof by said device.

16. The method set forth in claim 11 wherein:

said drivepipe includes a cable connected to said means for releasing said drivepipe from said device and extending through said drivepipe and said method includes the step of:

pulling on said cable to determine if said means for releasing said drivepipe has been actuated.

17. The method set forth in claim 11 wherein:

said drivepipe includes a cable connected to said means for releasing said drivepipe from said device and extending through said drivepipe and said method includes the step of:

pulling on said cable to effect release of said drivepipe from said device.

* * * * *